United States Patent [19]

Jellen

[11] Patent Number: 5,018,474

[45] Date of Patent: May 28, 1991

[54] SKI ROPE ATTACHMENT DEVICE

[75] Inventor: David L. Jellen, Dos Palos, Calif.

[73] Assignee: Malibu Boats, Inc., Merced, Calif.

[21] Appl. No.: 498,043

[22] Filed: Mar. 22, 1990

[51] Int. Cl.[5] ..... B63B 21/04

[52] U.S. Cl. ..... 114/253; 403/165; 114/242; 254/416

[58] Field of Search ..... 114/242, 249, 251, 253, 114/381, 218; 59/95; 403/164, 165; 254/DIG. 14, 390, 416; 446/33, 34; 40/215; 273/360; 280/292, 480

[56] References Cited

U.S. PATENT DOCUMENTS 391,152 10/1888 Johnson ..... 114/218

4,893,577 1/1990 Jennings ..... 114/253

FOREIGN PATENT DOCUMENTS 738102 10/1955 United Kingdom ..... 114/218

*Primary Examiner*—Ed Swinehart

*Attorney, Agent, or Firm*—Flehr, Hohbach, Test, Albritton & Herbert

[57] ABSTRACT

A device is disclosed for attaching a ski rope to the pylon of a towing boat for preventing chatter and wear on the front end of the rope. The device includes a vertically extending support pin which is mounted on the upper end of the pylon. A cylindrical swivel head is mounted by means of an anti-friction bearing on the support pin for rotation about a vertical axis. The swivel head is formed with an annular groove which is intermediate upper and lower shoulders that are sized to retain a loop on the front end of the rope onto the swivel head during towing. The rope loop freely turns with the swivel head as the rope angularly displaces relative to the boat during towing.

5 Claims, 2 Drawing Sheets

SKI ROPE ATTACHMENT DEVICE

BACKGROUND OF THE INVENTION

This invention in general relates to the sport of water skiing. More particularly, the invention relates to mechanical arrangements for attaching ski ropes to pylons on a towing boat.

Competition and pleasure water ski boats commonly employ a vertical pylon fixedly mounted near the center of the boat for attaching the front end of a ski rope for towing skiers. The conventional means for attaching the ski ropes to the pylons have a number of drawbacks and limitations. Friction created between the rope and pylon, such as when the skier swings back and forth through an arc behind the boat, leads to wear in the rope. The friction also creates a condition known as rope chatter or ratcheting in which the attachment loop at the front of the rope tends to jerk as it turns around the pylon head. This creates a loss of feel and control for the skier, and competitive skiers find this particularly objectionable.

Among the prior art ski pylon attachment devices is that in which a Teflon collar is mounted to swivel on the pylon head, with the rope loop attached about the collar. However, in such an arrangement the moving elements have a tendency to bind, and the tracking is not smooth as the rope swings back and forth behind the boat.

OBJECTS AND SUMMARY OF THE INVENTION

Accordingly, it is an objection of the present invention to provide a new and improved ski rope attachment device which obviates many of the disadvantages and limitations of the prior art attachment devices.

Another object is to provide a ski rope attachment device of the type described in which the front end of the ski rope freely swivels without inducing rope wear and without objectionable chatter or ratcheting during skiing.

Another object is to provide a ski rope attachment device of the type described in which the front end of the rope is pulled by a swivel head which is mounted by anti-friction bearings on the upper end of the pylon in the towing boat.

The invention in summary includes a cylindrical swivel head which is mounted by anti-friction bearing means on a vertically extending support pin which in turn is mounted on the upper end of the towing boat pylon. The outer periphery of the swivel head is formed with an annular groove which is sized sufficient for carrying the attachment loop of the ski rope. The rope loop and swivel head freely rotate on the bearing means about a vertical axis as the rope turns back and forth through a arc behind the boat during skiing.

The foregoing and additional objects and features of the invention will appear from the following specification in which the preferred embodiment has been described in detail in conjunction with the accompanying drawings.

DESCRIPTION OF THE PREFERRED EMBODIMENT

Figure 1:
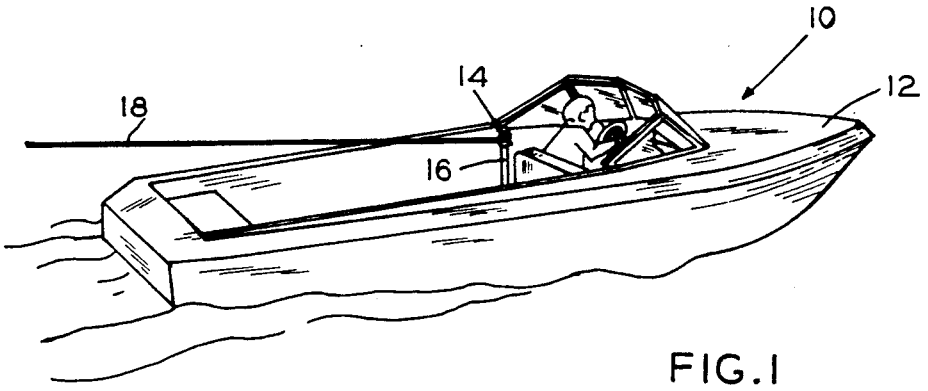
FIG. 1 is a side elevational view of a typical ski boat incorporating the rope attachment device of the invention.
Figure 2:
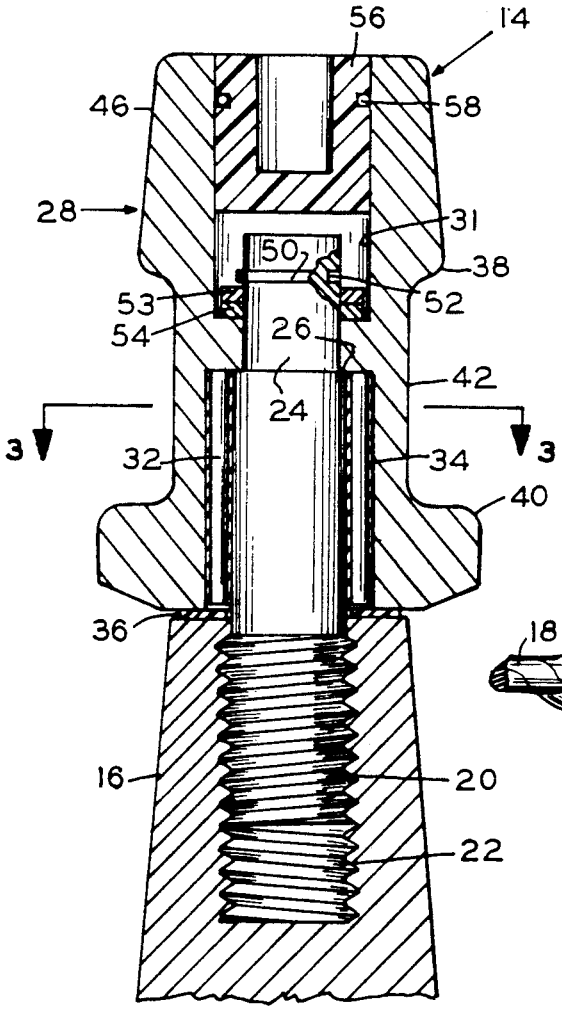
FIG. 2 is a vertical axial section view to an enlarged scale of the attachment device shown in FIG. 1.

In the drawings FIG. 1 illustrates generally at 10 a typical towing boat 12 incorporating a ski rope attachment device 14 according to the preferred embodiment of the invention. Towing boat 12 is provided with a pylon 16 which is fixedly mounted in an upright orientation at approximately the center of the boat. As is well known, the attachment of the ski rope 18 to a center-mounted pylon permits the boat to stay in better trim when the skier is under tow.

While the present embodiment is described for use with water skiing, it is understood that the invention has applicability to a range of ski-related sports activities, for example barefoot skiers, skurfers and kneeboards which are pulled through water behind a towing boat.

Attachment device 14 includes a mounting pin 20, which can be of stainless steel, threadably mounted at its lower end within a bore 22 formed axially through the upper end of the pylon. The upper distal end 24 of the mounting pin is formed with a reduced diameter and joins with the lower end at a shoulder 26.

A cylindrical swivel head 28 is coaxially mounted about the upper end of pin 20, and an intrusive shoulder 30 formed within a coaxial bore 31 of the swivel head is mounted with a loose fit about pin upper end 24. An anti-friction bearing 32, which preferably is a needle bearing, is provided with its outer race fitted within a bore 34 formed coaxially through the lower end of the swivel head and with its inner race fitted about the mounting pin. A suitable low-friction washer 36, such a Nylon washer, is mounted between the upper circular end face of the pylon and the swivel head to act as a bearing surface for vertical load forces.

Figure 3:
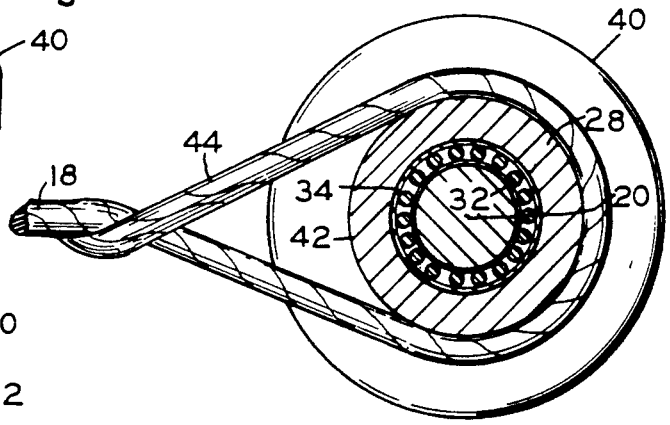
FIG. 3 is a cross-sectional view taken along the line 3—3 of FIG. 2 illustrating the loop of a ski rope attached to the device.

Swivel head 28 is formed at its distal end with an upper annular shoulder 38 and at its proximal end with a lower annular shoulder 40. The shoulders are separated by a cylindrical attachment surface 42 having a flat profile which provides the surface for securing the loop 44 at the front of the ski rope, as best shown in FIG. 3. The two shoulders and surface 42 form an annular groove of a size sufficient for preventing the ski rope from becoming detached during normal operation. Preferably the outer diameter of lower shoulder 40 is enlarged to ensure that the loop does not disengage when the rope is slack. An outer diameter of approximately 1.5" for attachment surface 42, an outer diameter of approximately 2.0" for upper shoulder 38 and an outer diameter of approximately 2.5" for lower shoulder 40 are optimum for purposes of the invention.

Distal end 46 of the swivel head tapers upwardly to facilitate placing the rope loop down over the swivel head and into the annular groove. Coaxial bore 32 in the upper end of the swivel head provides access to a snap ring 50 which is detachably mounted in a groove 52 formed about the upper end of the mounting pin. A pair of washers 53, 54 are coaxially mounted between the snap ring and intrusive shoulder 30 of the swivel head. The upper end of bore 32 is fitted with a cylindrical plastic filler cap 56, and an O-ring seal 58 is mounted in an annular slot formed about the upper end of the filler cap to provide a barrier against moisture penetration.

Filler cap 56 is removed for access to install or remove snap ring 50 so that the swivel head can be fitted onto or removed from the mounting pin.

In operation, with the loop 44 at the front of the ski rope secured within the swivel head groove, one or more skiers are towed behind the boat. As the skiers swing back and forth behind the boat, the ski rope swings through an arc which can be as large as 160°. During high speed towing, for example 36 mph or more, the pulling forces on the rope can be as high as 1600 pounds. Even with these high pulling forces the swivel head freely turns about the pylon without friction on the rope and without inducing ratcheting or chatter. With the eliminating of such ratcheting or chatter a competitive skier senses better feel and has more control.

While the foregoing embodiment is at present considered to be preferred it is understood that numerous variations and modifications may be made therein by those skilled in the art and it is intended to cover in the appended claims all such variations and modifications as fall within the true spirit and scope of the invention.

What is claimed is:

1. A device for attaching the front end of a water ski rope to the pylon on a towing boat in which the pylon is fixedly mounted in an upright position, said device comprising the combination of a vertically extending support pin having a proximal end mounted on the upper end of the pylon and a distal end extending upwardly from the pylon, a cylindrical swivel head formed about its outer periphery with an annular groove which is sized for carrying a loop on the end of said ski rope, the swivel head being formed at its lower end with a vertically axised lower bore, bearing means comprising an annular anti-friction bearing mounted within the lower bore and about the proximal end of the support pin for rotation of the swivel head about a vertical axis whereby during angular movement of the rope relative to the boat the loop of the rope freely rotates with the swivel head about said vertical axis to obviate chattering and wear of the rope, said swivel head being formed at its upper end with a vertically axised upper bore which extends downwardly about an upper portion of the distal end of the support pin, a peripheral groove formed about said upper portion of the distal end of the support pin, snap ring means releasably seated in the peripheral groove for preventing unintended relative axial movement of the swivel head from the support pin, an elastomeric filler cap having a cross-sectional shape sized to releasably fit within said upper bore, and means providing a water-tight seal between the filler cap and upper bore to prevent penetration of water into the upper bore and bearing.

2. A device as in claim 1 in which the swivel head includes upper and lower annular shoulders axially spaced-apart on opposite sides of the groove, said annular shoulders extending radially from the groove sufficient to retain the rope loop within the groove during towing.

3. A device as in claim 1 in which said bearing means comprises an annular needle bearing mounted within the lower bore and about the support pin.

4. A device as in claims 2 in which the swivel head is formed at its lower end with an annular flat bearing surface in a plane orthogonal with said vertical axis, said bearing surface pivoting about the upper end of the pylon to resist vertical load forces imposed on the swivel head.

5. A device as in claim 2 in which said annular groove has an outer diameter of substantially 1.5", said upper shoulder at a portion thereof adjacent the annular groove has an outer diameter of substantially 2.0", and said lower shoulder at a portion thereof adjacent the groove has an outer diameter of approximately 2.5".

* * * * *